US006273683B1

(12) United States Patent
Zagar et al.

(10) Patent No.: US 6,273,683 B1
(45) Date of Patent: Aug. 14, 2001

(54) TURBINE BLADE PLATFORM SEAL

(75) Inventors: Thomas W. Zagar, Winter Springs; Anthony L. Schiavo, Oviedo, both of FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/245,816

(22) Filed: Feb. 5, 1999

(51) Int. Cl.[7] ..... F01D 5/22

(52) U.S. Cl. ..... 416/193 A; 416/190; 416/248; 416/500; 277/421; 277/643

(58) Field of Search ..... 416/190, 191, 416/193 A, 220 R, 145, 248, 500; 415/135, 136, 138, 139; 277/421, 422, 643

(56) References Cited

U.S. PATENT DOCUMENTS

| | | | | |
|---|---|---|---|---|
| 2,912,223 | * | 11/1959 | Hull, Jr. | 416/500 |
| 3,519,366 | * | 7/1970 | Campbell | 415/138 |
| 3,751,183 | | 8/1973 | Nichols et al. . | |
| 3,752,598 | * | 8/1973 | Bowers et al. | 416/191 |
| 3,807,898 | | 4/1974 | Guy et al. . | |
| 3,834,831 | | 9/1974 | Mitchell . | |
| 3,853,425 | | 12/1974 | Scalzo et al. . | |
| 3,887,298 | | 6/1975 | Hess et al. . | |
| 3,967,353 | | 7/1976 | Pagnotta et al. . | |
| 4,111,603 | | 9/1978 | Stahl . | |
| 4,242,045 | | 12/1980 | Grondahl et al. . | |
| 4,326,835 | | 4/1982 | Wertz . | |
| 4,343,594 | | 8/1982 | Perry . | |
| 4,422,827 | | 12/1983 | Buxe et al. . | |
| 4,524,980 | * | 6/1985 | Lillibridge et al. | 416/193 A |
| 4,551,064 | | 11/1985 | Pask . | |
| 4,580,946 | | 4/1986 | Bobo . | |
| 4,668,164 | | 5/1987 | Neal et al. . | |
| 4,767,260 | * | 8/1988 | Clevenger et al. | 415/139 |
| 4,813,848 | | 3/1989 | Novotny . | |
| 4,872,812 | | 10/1989 | Hendley et al. . | |
| 5,139,389 | | 8/1992 | Eng et al. . | |
| 5,167,485 | * | 12/1992 | Starkweather | 415/138 |
| 5,201,849 | | 4/1993 | Chambers et al. . | |
| 5,228,835 | | 7/1993 | Chlus . | |
| 5,244,345 | * | 9/1993 | Curtis | 416/193 A |
| 5,256,035 | | 10/1993 | Norris et al. . | |
| 5,257,909 | | 11/1993 | Glynn et al. . | |
| 5,281,097 | | 1/1994 | Wilson et al. . | |
| 5,388,962 | | 2/1995 | Wygle et al. . | |
| 5,429,478 | | 7/1995 | Krizan et al. . | |
| 5,460,489 | | 10/1995 | Benjamin et al. . | |
| 5,478,207 | | 12/1995 | Stec . | |
| 5,531,457 | * | 7/1996 | Tibbott et al. | 415/139 |
| 5,599,170 | | 2/1997 | Marchi et al. . | |
| 5,655,876 | * | 8/1997 | Rock et al. | 415/139 |
| 5,785,499 | | 7/1998 | Houston et al. . | |
| 5,803,710 | | 9/1998 | Dietrich et al. . | |
| 6,086,329 | * | 7/2000 | Tomita et al. | 416/193 A |

OTHER PUBLICATIONS

Research Disclosure No. 10621, disclosed anonymously, Feb. 1973.*

* cited by examiner

*Primary Examiner*—Christopher Verdier
(74) *Attorney, Agent, or Firm*—Eckert Seamans Cherin & Mellot, LLC

(57) ABSTRACT

A rotating blade group 90 for a turbo-machine having an improved device for sealing the gap 110 between the edges 112,114 of adjacent blade platforms 96,104. The gap 110 between adjacent blades 92,100 is sealed by a seal pin 20 its central portion 110 and by a seal plate 58,60 at each of the front 54 and rear 56 portions. The seal plates 58,60 are inserted into corresponding grooves 62,64 formed in the adjacent edges 112,114 of adjoining blades 92,100 and held in place by end plates 40,42. The end of the seal plates 58,60 may be chamfered 78,80 to improve the seal against the end plate 40,42. The seal pin 20 provides the required damping between the blades 92,100 and the seal plates 58,60 provide improved sealing effectiveness.

15 Claims, 3 Drawing Sheets

TURBINE BLADE PLATFORM SEAL

This invention was made with United States Government support under contract number DEFC21-95MC32267 awarded by the Department of Energy. The Government has certain rights in this invention.

FIELD OF THE INVENTION

This invention relates generally to the field of turbo-machines, and more particularly to the field of gas or combustion turbines, and specifically to an apparatus for sealing the gap between adjacent platforms in a row of rotating blades in a combustion turbine engine.

BACKGROUND OF THE INVENTION

Turbo-machines such as compressors and turbines generally include a rotating assembly having a centrally located rotor shaft and a plurality of rows of rotating blades attached thereto, and a corresponding plurality of rows of stationary vanes connected to the casing of the turbo-machine and interposed between the rows of rotating blades. A working fluid such as air or combustion gas flows through the rows of rotating blades and stationary vanes to transfer energy between the working fluid and the turbo-machine.

A rotating blade of a turbo-machine typically includes a root section attached to the rotor, a platform section connected to the root section, and an airfoil section connected to the platform section on a side opposite from the root section. The edges of platform sections of adjacent blades in a row of blades abut each other to form a portion of the boundary defining the flow path for the working fluid. While it would be desirable to have adjacent platforms abut in a perfect sealing relationship, the necessity to accommodate thermal growth and machining tolerances results in a small gap being maintained between adjacent platforms.

Prior art turbo-machines have incorporated many types of devices to seal the gap between the platforms of adjacent blades, and also to provide a mechanical damping therebetween. For low temperature applications such as a compressor, U.S. Pat. Nos. 4,422,827 and 4,580,946 teach the use of an elastomeric material to seal the gap between adjacent blade platforms. For high temperature applications such as a combustion turbine, U.S. Pat. Nos. 4,326,835 and 5,281,097 teach the use of a metal plate affixed under the platforms of adjacent blades to seal the gap. Furthermore, it is known to provide sealing and damping functions in one device installed under the blade platforms, such as is shown in U.S. Pat. Nos. 3,751,183; 4,872,812; 5,785,499; and 5,803,710. Each of the above cited patents is incorporated by reference herein. The prior art devices are either expensive to manufacture, complicated to install, or lack sufficient sealing effectiveness for modern combustion turbine applications.

Accordingly, it is an object of this invention to provide an improved device for sealing and damping between the platforms of adjacent rotating blades in a turbo-machine. It is a further object to provide a device for sealing and damping that can be manufactured by simple, known manufacturing techniques, that is easy to install and to remove, and that provides improved sealing effectiveness.

SUMMARY

In order to achieve these and other objects of the invention, a blade group for a turbo-machine is provided having a first blade having a first platform section with a first edge; a second blade having a second platform section with a second edge located adjacent the first edge and forming a gap therebetween; a first groove formed in the first edge; a second groove formed in the second edge; and a first seal plate inserted into the first groove and the second groove and spanning a first portion of the gap.

The blade group of this invention may further have a third groove formed in the first edge; a fourth groove formed in the second edge; a second seal plate inserted into the third groove and the fourth groove and spanning a second portion of the gap.

The blade group of this invention may further have a fifth groove formed in the first edge, the fifth groove having a first end proximate a first end of the first groove and a second end proximate a first end of the third groove; a seal pin inserted into the fifth groove, said seal pin having a first end proximate a first end of the first seal plate and a second end proximate a first end of the second seal plate, the seal pin operable to make contact with the second edge and to span a third portion of the gap.

The blade group of this invention may further have a first end plate covering an end of the first groove and an end of the second groove and operable to retain the first seal plate within the first groove and the second groove, and a chamfer formed on a second end of the first seal plate adjacent the first end plate.

Like structures are numbered consistently in each of these figures.

DESCRIPTION OF THE PREFERRED EMBODIMENTS

Modern combustion turbine engines utilize a portion of the compressed air generated by the compressor section of the engine as a cooling fluid for cooling hot components of the combustor and turbine sections of the engine. In an open loop cooling system design, the cooling fluid is released into the working fluid flow after it has removed heat from the hot component. For the most advanced engines that are designed to operate at the highest efficiencies, a closed loop cooling scheme may be used. In a closed loop cooling system the cooling fluid is not released into the working fluid in the turbine, but rather is cooled and returned to the compressor section. In these high efficiency engines, the effectiveness of the seal between adjacent rotating blade platforms is of great importance.

Figure 1:
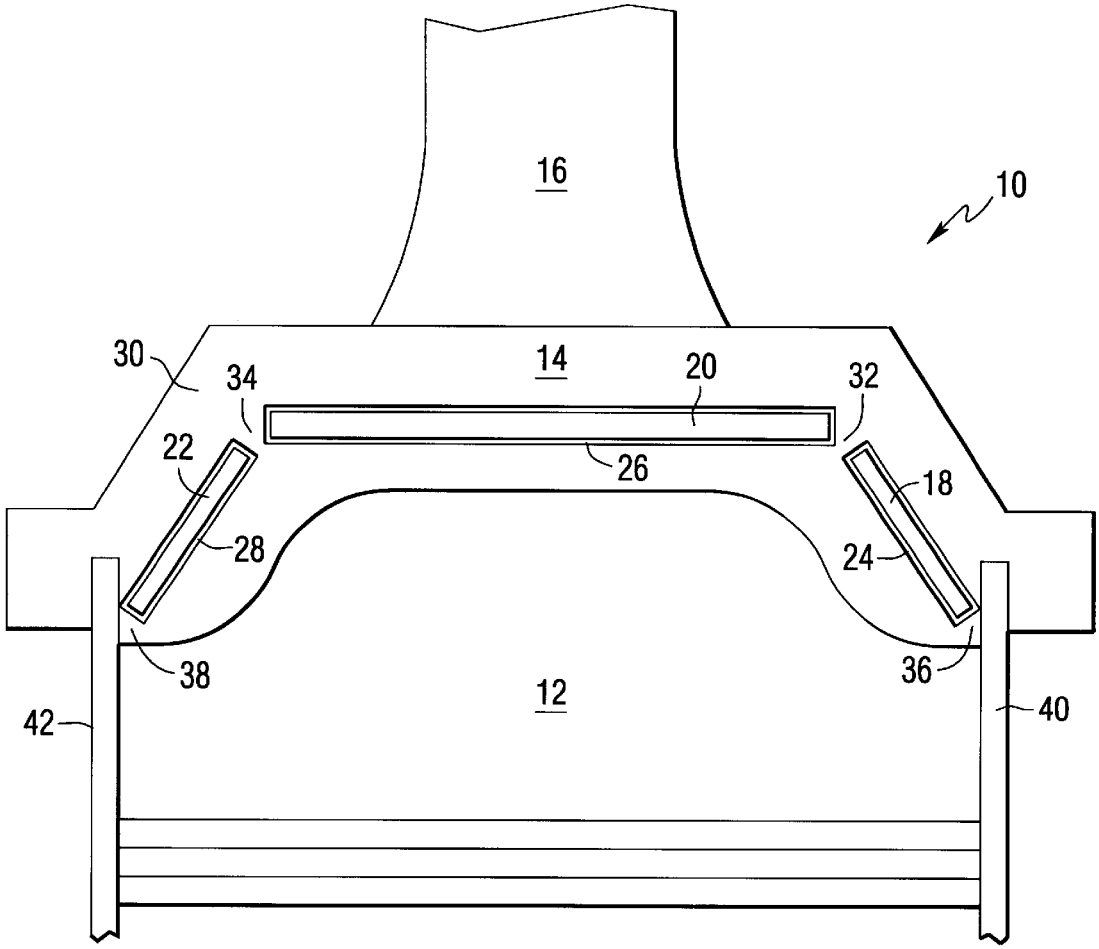
FIG. 1 PRIOR ART
FIG. 1 is a front view of a rotating blade of a turbo-machine as is known in the prior art.

FIG. 1 illustrates a rotating blade 10 from a prior art combustion turbine engine. The blade 10 includes a root section 12 for attaching the blade to the rotor shaft (not shown) and a platform section 14 attached to the root section 12. The platform section 14 forms a portion of the flow path for the working fluid. An airfoil portion 16 is attached to the platform section 14 on an opposite side from the root portion 12. The airfoil section 16 extracts heat and pressure energy from the working fluid as it passes over the blade 10 and converts the energy into mechanical energy by rotating the rotor shaft. The platform section 14 is sealed and damped against the platform section of an adjoining blade (not shown) by three seal pins 18,20,22. The pins 18,20,22 are set into grooves 24,26,28 formed into an edge 30 of the platform section 14. The grooves 24,26,28 are formed in a direction along their depth dimension that is not tangential to the axis of the rotor shaft, for example at an angle of about 7–14 degrees, or even as much as 30 degrees. As a result of this angle, centrifugal force created by the rotation of the rotor assembly will cause the pins 18,20,22 to be forced out of the grooves 24,26,28 and against the edge of the platform of the adjoining blade, thereby providing a seal and a damping structure.

The design of FIG. 1 provides the required damping between the adjacent blades, and adequate sealing of the gap between adjacent blades for most applications. It does not, however, provide optimal sealing performance for the highest efficiency turbine engines utilizing closed loop cooling schemes. These engines use cooling fluid pressures that are significantly higher than open loop cooling systems, for example three to four times the pressure of the working fluid. Even a small gap between adjacent blades in these engines can result in a significant loss of cooling fluid through the gap. In particular, the two spaces 32,34 between the ends of adjacent sealing pins 18-20,20-22 and the two spaces 36,38 between the pins 18,22 and the blade end plates 40,42 can give rise to a measurable efficiency loss for the engine. Also, due to the angle of the front and rear pins with respect to the axis of rotation of the rotor shaft, the sealing force applied by centrifugal force is limited, and the sealing effectiveness along the length of the front and rear seal pins 18,22 may be less than optimal.

Figure 2:
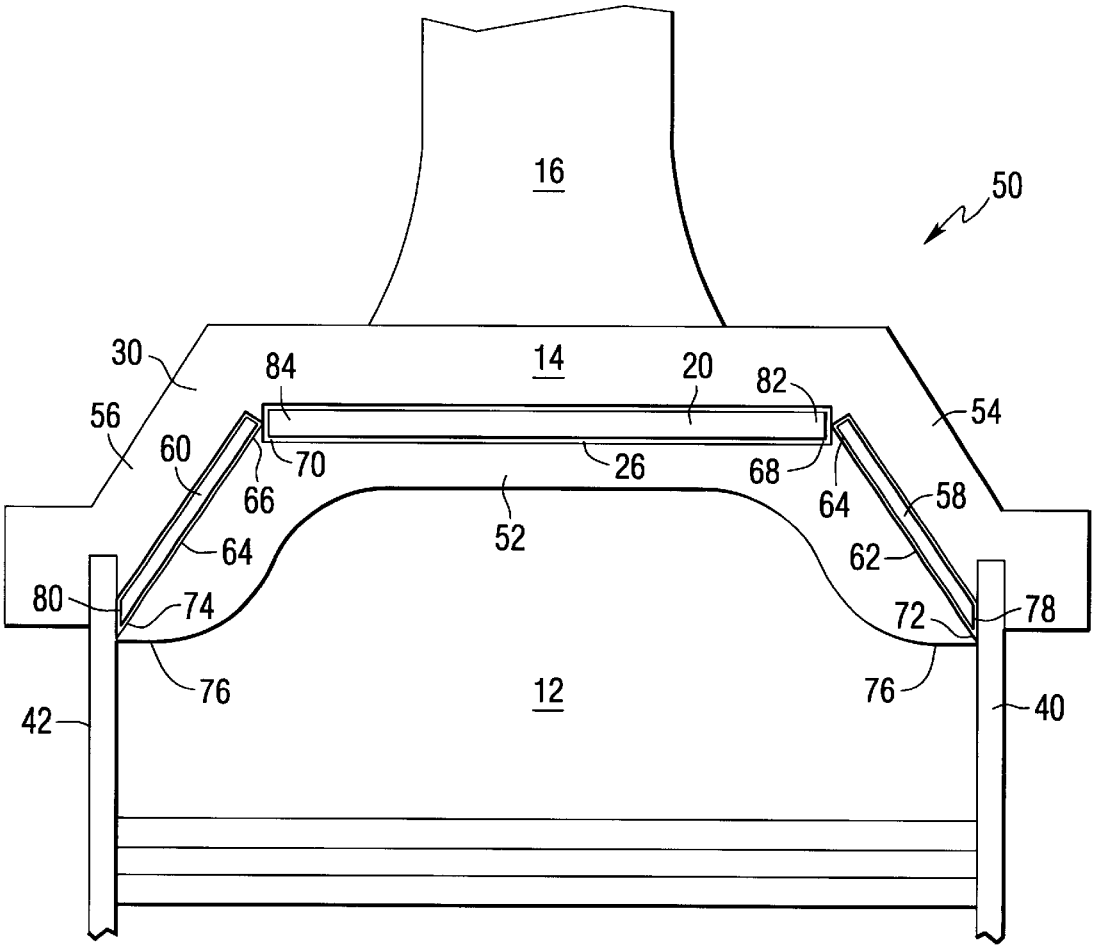
FIG. 2 is a front view of a rotating blade of a turbo-machine built in accordance with the present invention.

FIG. 2 illustrates a rotating blade 50 built in accordance with the present invention and having a sealing mechanism that overcomes the shortcomings of the prior art blade 10 of FIG. 1. The blade 50 of FIG. 2 has a root section 12, a platform section 14 with an edge 30, and an airfoil section 16, as in the prior art blade. A seal pin 20 is disposed in a groove 26 formed into an edge 30 of the blade 50. The seal pin 20 provides the required damping between adjacent blades, and provides an effective seal for a center portion 52 of the gap between the blades. The front and rear portions 54,56 of the platform 14 each contain a seal plate 58,60 inserted into respective grooves 62,64 in the edge 30 of the platform 14. The grooves 62,64 for the seal plates 58,60 each have one end 64,66 formed to be proximate the ends 68,70 of the groove 26 for the sealing pin 20, and a second end 72,74 opening to the bottom edge 76 of the platform 14. An adjacent blade will be formed to have corresponding grooves formed into its edge so that the seal plates 58,60 may be inserted into the grooves of both adjacent blades at the same time, thereby spanning that portion of the gap between the edges of the blade platforms. The seal plates 58,60 are retained in the grooves by blade end plates 40,42 affixed to the front and rear faces of the blade 50.

Seal plates are known to be used in turbines for sealing the gaps between the shrouds of adjacent stationary vanes. Stationary vanes are not subject to centrifugal forces during operation of the turbine, and seal plates in stationary applications are effective in maintaining a seal between stationary parts. Seal plates have not previously been used for rotating blade applications because they do not provide the necessary damping function and because the stresses and resulting deformations caused by centrifugal forces were expected to reduce their effectiveness as a sealing mechanism. The applicants have discovered that, for certain rotating applications such as the front 54 and rear 56 portions of a rotating blade platform, seal plates can provide a better seal than prior art devices. Furthermore, by combining the improved sealing properties of a seal plate with the damping properties of a seal pin, an improved seal design is possible.

As shown in FIG. 2, there is little or no gap between the ends of the seal pin 20 and the ends of the seal plates 58,60. The rectangular cross section of the seal plate provides for improved seal effectiveness when compared to prior art pin-to-pin interface as shown in FIG. 1. Preferably, the grooves are positioned so that the edge of each seal plate contacts the end 82,84 of the seal pin along a diameter of the seal pin during the operation of the turbo-machine. This provides the maximum sealing surface area between the seal pin 20 and the seal plates 58,60, thereby minimizing the flow of cooling air between the adjacent blades. Additionally, the end of the seal plates 58,60 nearest the blade end plates 40,42 may be provided with a chamfer 78,80 to improve the effectiveness of the seal between the seal plates 58,60 and the blade end plates 40,42. The chamfer 78,80 provides area contact between the seal plate 58,60 and the end plate 40,42, as opposed to point contact provided in the prior art design. Furthermore, since seal plates 58,60 do not depend upon centrifugal force to form a seal, they may perform better along their length than prior art seal pins 18,22 in applications where they are positioned at an angle to a tangent to the axis of rotation, such as in the front 54 and rear 56 of the platform section 14 as shown in FIG. 2. Thus, the design of FIG. 2 utilizes the good sealing and damping properties of a seal pin 20 in the central portion 52 of the platform section 14, and it improves upon the seal effectiveness in the areas of highest leakage in the prior art design of FIG. 1. In addition to reducing the leakage at the ends 82,84 of the central pin 20 and at the interface with the end plate 72,74, the seal plates 58,60 may form a better seal along their lengths than prior art seal pins 18,22 in these locations.

Figure 3:
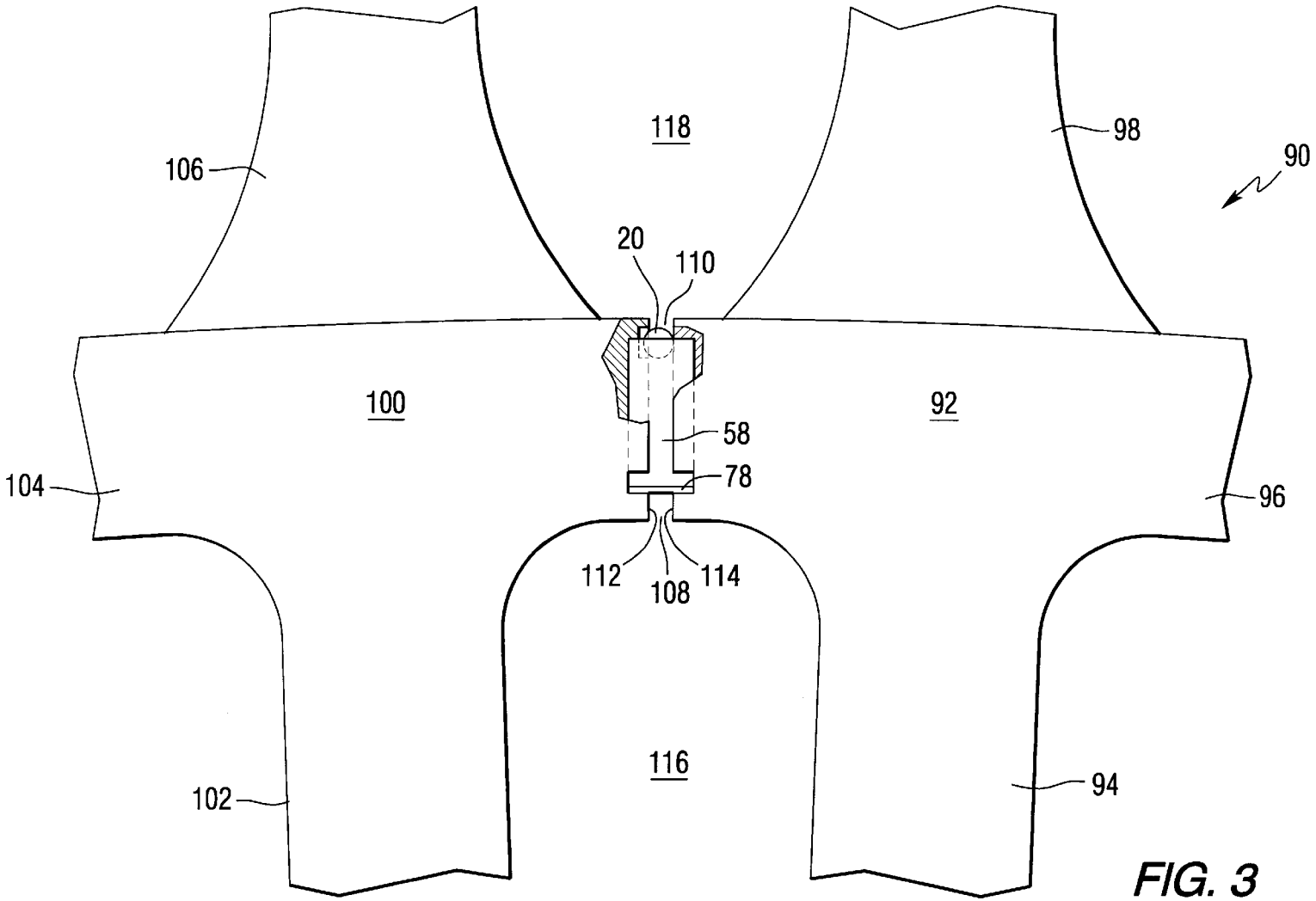
FIG. 3 is a side view of a portion of a rotating blade group of a turbo-machine built in accordance with the present invention.

FIG. 3 illustrates a portion of a blade group 90 of a row of rotating blades for a combustion turbine built in accordance with this invention. A first blade 92 having root 94, platform 96 and airfoil 98 sections is located on the rotor shaft (not shown) adjacent a second blade 100 also having root 102, platform 104 and airfoil 106 sections. A gap 108 exists between the edges of the first 92 and second 94 blades. A center portion 110 of the gap 108 is spanned by seal pin 20 which is disposed in a groove formed in the edge 112 of the first blade 92. The seal pin 20 is urged toward the edge 114 of the second blade by centrifugal force as the blades 92,100 rotate about the axis of the rotor shaft. A seal plate 58 spans a portion of the gap 110 between the blades 92,100. The seal plate 58 is inserted into corresponding grooves formed in the opposing edges 112,114 of the two blades 92,100, thereby spanning the gap 110 and sealing a portion thereof. One end of the seal plate 58 is located proximate one end of the seal pin 20, preferably contacting it along its diameter during operation of the turbo-machine in which the blade group 90 is installed. The other end of the seal plate 58 is chamfered 78 to fit against a surface of a blade side plate (not shown) which is attached between the blades 92,100 and serves to retain the seal plate 58 within its groove. The seal plate 58 is sized to be slide into its groove and is held in position by the side plate. A second seal plate (not shown) is positioned between the blades 92,100 on the opposite side of the platform portions.

Seal plates 58,60 are preferably thin rectangular members formed of a high temperature alloy material. In one application the nominal gap 110 between adjacent blade platforms is about 3.5 mm, the seal plate groove depth is about 6 mm in each of the adjoining platform edges, and the width of the seal plate is about 15 mm. To assure easy installation of the seal plate 58,60, the width of the grooves formed in the platform edges 30,112,114 should be somewhat greater than the thickness of the seal plate 58,60. The thickness of the seal plate 58,60 may be about 2 mm, and the width of the grooves 62,64 to accommodate the seal plate thickness may be about 2.5 mm. The differential pressure across the seal plate 58,60 will force the seal plate against one wall of the groove 62,64 , thereby providing an effective seal without depending upon centrifugal force.

It is important that the tolerances of the blade and groove dimensions are controlled so that the grooves of the adjoining blades 92,100 align properly to facilitate easy insertion of the seal plate 58. The grooves 26,62,64 for the seal pin 20 and the seal plates 58,60 may be formed by machining methods known in the art; for example by an EDM process. The seal plates 58,60 may be mechanically attached to one blade, but in a preferred embodiment they are free to move within the grooves. It is expected that the seal plates will not experience significant wear, as do seal pins, since they will carry little or no load between the adjacent blade platforms.

Figure 4:
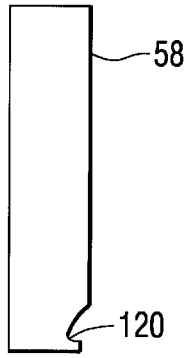
FIG. 4 is a side view of a seal plate formed in accordance with this invention.

FIG. 4 illustrates a seal plate 58 that incorporates a hook 120 at one end of the seal plate. The hook 120 provides a means for removal of the seal plate during disassembly of the turbo-machine. A tool (not shown) is used to engage the hook 120 in order to pull the installed seal plate 58 out of the groove in the blade platform. Hook 120 is formed in the seal plate 58 within the plane of the seal plate 58, i.e. in the plane of the paper of FIG. 4. Hook 120 is formed proximate an end of the seal plate 58 so that even when seal plate 58 is fully inserted into groove 62, the tool can be inserted into the groove to engage hook 120 to pull seal plate 58 out of groove 62. Other means for removing the seal plate may include a hole, a loop end, or any structure that facilitates the application of a pulling force on the installed seal plate 58.

The seal plates 58,60, and the combination of the seal plates 58,60 with the seal pin 20, provide an effective seal across the gap 110 between adjacent blades 92,100, thereby preventing the loss of cooling air from the area 116 under the blade platforms to the area 118 of the working fluid passing through the airfoil sections 98,106.

Other aspects, objects and advantages of this invention may be obtained by studying the Figures, the disclosure, and the appended claims.

What is claimed is:

1. A blade group in a turbo-machine comprising:

a first blade having a first platform section with a first edge;

a second blade having a second platform section with a second edge located adjacent said first edge and forming a gap therebetween;

a first groove formed in said first edge;

a second groove formed in said second edge; and a first seal plate inserted into said first groove and said second groove and spanning a first portion of said gap;

a third groove formed in said first edge;

a fourth groove formed in said second edge;

a second seal plate inserted into said third groove and said fourth groove and spanning a second portion of said gap, a fifth groove formed in said first edge, said fifth groove having a first end proximate a first end of said first groove and a second end proximate a first end of said third groove;

a seal pin inserted into said fifth groove, said seal pin having a first end proximate a first end of said first seal plate and a second end proximate a first end of said second seal plate, said seal pin operable to make contact with said second edge and to span a third portion of said gap.

2. The blade group of claim 1, further comprising a first end plate covering a second end of said first groove and an end of said second groove and operable to retain said first seal plate within said first groove and said second groove.

3. The blade group of claim 2, further comprising a chamfer formed on a second end of said first seal plate adjacent said first end plate.

4. The blade group of claim 2, further comprising a second end plate covering a second end of said third groove and an end of said fourth groove and operable to retain said second seal plate within said third groove and said fourth groove.

5. The blade group of claim 4, further comprising a chamfer formed on a second end of said second seal plate adjacent said second end plate.

6. The blade group of claim 1, further comprising said fifth groove being positioned so that an edge of the first end of said first seal plate contacts the first end of said seal pin along a diameter of the seal pin during the operation of the turbo-machine.

7. The blade group of claim 6, further comprising said fifth groove being positioned so that an edge of the first end of said second seal plate contacts the second end of said seal pin along a diameter of the seal pin during the operation of the turbo-machine.

8. The blade group of claim 1, further comprising an end plate covering an end of said first groove and operable to retain said first seal plate within said first groove.

9. The blade group of claim 8, further comprising a chamfer formed on an end of said first seal plate proximate said end plate.

10. The blade group of claim 1, further comprising a means for removal formed within a plane of the seal plate at an end of said first seal plate.

11. The blade group of claim 10, wherein said means for removal comprises a hook.

12. The blade group of claim 1, further comprising a means for removal formed within a plane of the seal plate at an end of each of said first and said second seal plates.

13. The blade group of claim 12, wherein said means for removal comprises a hook.

14. A blade group in a turbo-machine comprising:

a first blade having a first platform section with a first edge;

a second blade having a second platform section with a second edge located adjacent said first edge and forming a gap therebetween;

a first groove formed in said first edge;

a second groove formed in said second edge; and a seal plate inserted into said first groove and said second groove and spanning a first portion of said gap;

a third groove formed in said first edge, said third groove having an end proximate a first end of said first groove;

a seal pin inserted into said third groove, said seal pin having a first end proximate a first end of said seal plate, said seal pin operable to make contact with said second edge and to span a second portion of said gap;

said third groove being positioned so that an edge of the first end of said seal plate contacts the first end of said seal pin along an end face of the seal pin during the operation of the turbomachine.

15. The blade group of claim 14, further comprising a hook formed in the seal plate within a plane of the seal plate proximate a second end of the seal plate.

* * * * *